US007353879B2

(12) United States Patent
Todd et al.

(10) Patent No.: US 7,353,879 B2
(45) **Date of Patent: *Apr. 8, 2008**

(54) BIODEGRADABLE DOWNHOLE TOOLS

(75) Inventors: Bradley L. Todd, Duncan, OK (US); Phillip M. Starr, Duncan, OK (US); Loren C. Swor, Duncan, OK (US); Kenneth L. Schwendemann, Flower Mound, TX (US); Trinidad Munoz, Jr., Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 369 days.

This patent is subject to a terminal disclaimer.

(21) Appl. No.: 10/803,689

(22) Filed: Mar. 18, 2004

(65) Prior Publication Data

US 2005/0205266 A1 Sep. 22, 2005

(51) Int. Cl.
*E21B 29/00* (2006.01)

(52) U.S. Cl. ..... 166/376; 166/317

(58) Field of Classification Search ..... 166/376, 166/317

See application file for complete search history.

(56) References Cited

U.S. PATENT DOCUMENTS

| | | | | |
|---|---|---|---|---|
| 2,238,671 | A | 4/1941 | Woodhouse | 166/21 |
| 2,703,316 | A | 3/1955 | Schneider | |
| 3,173,484 | A | 3/1965 | Huitt et al. | 166/280.1 |
| 3,195,635 | A | 7/1965 | Fast | 166/280.1 |
| 3,302,719 | A | 2/1967 | Fischer | 166/280.2 |
| 3,364,995 | A | 1/1968 | Atkins et al. | 166/280.1 |
| 3,366,178 | A | 1/1968 | Malone et al. | 166/280.1 |
| 3,455,390 | A | 7/1969 | Gallus | 166/295 |
| 3,784,585 | A | 1/1974 | Schmitt et al. | 260/861 |
| 3,828,854 | A | 8/1974 | Templeton et al. | 166/307 |

(Continued)

FOREIGN PATENT DOCUMENTS

EP 0681087 * 5/1995

(Continued)

OTHER PUBLICATIONS

Simmons, et al., "Poly(phenyllactide): Synthesis, Characterization, and Hydrolytic Degradation," Biomacromolecules, vol. 2, No. 3, 2001 (pp. 658-663).

(Continued)

*Primary Examiner*—William P. Neuder
*Assistant Examiner*—Nicole Coy
(74) *Attorney, Agent, or Firm*—John W. Wustenberg; Conley Rose, P.C.

(57) ABSTRACT

A disposable downhole tool or a component thereof comprises an effective amount of biodegradable material such that the tool or the component thereof desirably decomposes when exposed to a wellbore environment. In an embodiment, the biodegradable material comprises a degradable polymer. The biodegradable material may further comprise a hydrated organic or inorganic solid compound. The biodegradable material may also be selected to achieve a desired decomposition rate when the tool is exposed to the wellbore environment. In an embodiment, the disposable downhole tool further comprises an enclosure for storing a chemical solution that catalyzes decomposition. The tool may also comprise an activation mechanism for releasing the chemical solution from the enclosure. In various embodiments, the disposable downhole tool is a frac plug, a bridge plug, or a packer.

92 Claims, 7 Drawing Sheets

U.S. PATENT DOCUMENTS 3,868,998 A 3/1975 Lybarger et al. ..... 166/278
3,912,692 A 10/1975 Casey et al.
3,960,736 A 6/1976 Free et al. ..... 252/8.55
3,968,840 A 7/1976 Tate ..... 166/280.1
3,998,744 A 12/1976 Arnold et al. ..... 507/269
4,068,718 A 1/1978 Cooke, Jr. et al. ..... 166/280.2
4,169,798 A 10/1979 DeMartino ..... 252/8.55 R
4,187,909 A 2/1980 Erbstoesser
4,387,769 A 6/1983 Erbstoesser et al.
4,417,989 A 11/1983 Hunter
4,470,915 A 9/1984 Conway ..... 252/8.55 R
4,526,695 A 7/1985 Erbstoesser et al. ... 252/8.55 R
4,715,967 A 12/1987 Bellis et al.
4,716,964 A 1/1988 Erbstoesser et al. ..... 166/284
4,743,257 A 5/1988 Tormala et al.
4,809,783 A 3/1989 Hollenbeck et al. ..... 166/307
4,843,118 A 6/1989 Lai et al. ..... 524/555
4,848,467 A 7/1989 Cantu et al.
4,957,165 A 9/1990 Cantu et al.
4,961,466 A 10/1990 Himes et al. ..... 166/250
4,986,353 A 1/1991 Clark et al.
4,986,354 A 1/1991 Cantu et al. ..... 166/279
4,986,355 A 1/1991 Casad et al.
5,082,056 A 1/1992 Tackett, Jr. ..... 166/295
5,131,472 A 7/1992 Dees et al.
5,216,050 A 6/1993 Sinclair
5,224,540 A 7/1993 Streich et al.
5,271,468 A 12/1993 Streich et al.
5,294,469 A 3/1994 Suzuki et al.
5,390,737 A 2/1995 Jacobi et al.
5,439,055 A 8/1995 Card et al. ..... 166/280
5,439,059 A 8/1995 Harris et al.
5,460,226 A 10/1995 Lawson et al. ..... 166/300
5,479,986 A 1/1996 Gano et al.
5,540,279 A 7/1996 Branch et al.
5,591,700 A 1/1997 Harris et al. ..... 507/204
5,607,017 A * 3/1997 Owens et al. ..... 166/288
5,607,905 A 3/1997 Dobson, Jr. et al. ..... 507/211
5,685,372 A 11/1997 Gano
5,689,085 A 11/1997 Turner
5,698,322 A 12/1997 Tsai et al. ..... 428/373
5,701,959 A 12/1997 Hushbeck et al.
5,765,641 A 6/1998 Shy et al.
5,839,515 A 11/1998 Yuan et al.
5,849,401 A 12/1998 El-Afandi et al. ..... 428/215
5,984,007 A 11/1999 Yuan et al.
5,990,051 A 11/1999 Ischy et al.
6,102,117 A 8/2000 Swor et al.
6,131,661 A 10/2000 Conner et al. ..... 166/300
6,135,987 A 10/2000 Tsai et al. ..... 604/365
6,143,698 A 11/2000 Murphey et al. ..... 507/145
6,161,622 A 12/2000 Robb et al.
6,162,766 A 12/2000 Muir et al. ..... 507/267
6,189,615 B1 2/2001 Sydansk ..... 166/270
6,209,646 B1 4/2001 Reddy et al.
6,218,343 B1 4/2001 Burts, Jr.
6,220,349 B1 4/2001 Vargus et al.
6,242,390 B1 6/2001 Mitchell et al. ..... 507/211
6,318,460 B1 11/2001 Swor et al.
6,323,307 B1 11/2001 Bigg et al.
6,328,105 B1 12/2001 Betzold
6,378,606 B1 4/2002 Swor et al.
6,387,986 B1 5/2002 Moradi-Araghi et al. ... 523/211
6,394,185 B1 5/2002 Constien ..... 166/296
6,422,314 B1 7/2002 Todd et al.
6,444,316 B1 9/2002 Reddy et al.
6,481,497 B2 11/2002 Swor et al.
6,494,263 B2 12/2002 Todd
6,527,051 B1 3/2003 Reddy et al.
6,554,071 B1 4/2003 Reddy et al.
6,599,863 B1 7/2003 Palmer et al.
6,655,459 B2 12/2003 Mackay
6,666,275 B2 12/2003 Neal et al.
6,667,279 B1 12/2003 Hessert et al.
6,669,771 B2 12/2003 Tokiwa et al. ..... 106/162
6,681,856 B1 1/2004 Chatterji et al.
6,710,019 B1 3/2004 Sawdon et al. ..... 507/136
6,761,218 B2 7/2004 Nguyen et al. ..... 166/278
6,837,309 B2 1/2005 Boney et al. ..... 166/280.2
7,036,587 B2 * 5/2006 Munoz et al. ..... 166/278
7,080,688 B2 7/2006 Todd et al. ..... 166/278
7,178,596 B2 2/2007 Blauch et al. ..... 166/280
2001/0016562 A1 8/2001 Muir et al. ..... 507/201
2002/0036088 A1 3/2002 Todd ..... 166/300
2002/0125012 A1 9/2002 Dawson et al. ..... 166/300
2003/0060374 A1 3/2003 Cooke, Jr. ..... 507/200
2003/0114314 A1 6/2003 Ballard et al. ..... 507/100
2003/0130133 A1 7/2003 Vallmer ..... 507/100
2003/0168214 A1 9/2003 Sollesnes ..... 166/250.08
2003/0213601 A1 11/2003 Schwendemann et al.
2003/0234103 A1 12/2003 Lee et al. ..... 166/293
2004/0014607 A1 1/2004 Sinclair et al. ..... 507/200
2004/0040706 A1 3/2004 Hossaini et al. ..... 166/278
2004/0152601 A1 8/2004 Still et al. ..... 507/100
2004/0231845 A1 11/2004 Cooke, Jr. ..... 166/279
2005/0006095 A1 1/2005 Justus et al. ..... 166/295
2005/0056425 A1 * 3/2005 Grigsby et al. ..... 166/296
2005/0126785 A1 6/2005 Todd ..... 166/307
2005/0205265 A1 9/2005 Todd et al.
2006/0105917 A1 5/2006 Munoz, Jr. ..... 507/103
2006/0283597 A1 12/2006 Schriener et al. ..... 166/300

FOREIGN PATENT DOCUMENTS

WO WO 00/57022 9/2000
WO WO 01/02698 1/2001
WO WO 2004/007905 1/2004
WO WO 2004/037946 A1 5/2004
WO WO 2004/038176 A1 5/2004

OTHER PUBLICATIONS

Yin, et al., "Preparation and Characterization of Substituted Polylactides," Am. Chem. Soc., vol. 32, No. 23, 1999 (pp. 7711-7718).

Yin, et al., "Synthesis and Properties of Polymers Derived from Substituted Lactic Acids," Am. Chem. Soc., Ch. 12, 2001 (pp. 147-159).

SPE 18211 "Laboratory and Field Evaluation of a Combined Fluid-Loss-Control Additive and Gel Breaker for Fracturing Fluids" by Lisa A. Cantu, et al.

Dechy-Cabaret, et al, *Controlled Ring-Opening Polymerization of Lactide and Glycolide*, American Chemical Society, Chemical Reviews, A-Z, AA-AD, received 2004.

Y. Chiang et al.: "Hydrolysis of Ortho Esters: Further Investigation of the Factors Which Control the Rate-Determining Step," Engineering Information Inc., NY, NY, vol. 105, No. 23 (XP-002322842), Nov. 16, 1983.

M. Ahmad, et al.: "Ortho Ester Hydrolysis: Direct Evidence for a Three-Stage Reaction Mechanism, "Engineering Information Inc., NY, NY, vol. 101, No. 10 (XP-002322843), May 9, 1979.

Skrabal et al., *The Hydrolysis Rate of Orthoformic Acid Ethyl Ether*, Chemical Institute of the University of Graz, pp. 1-38, Jan. 13, 1921.

Heller, et al., *Poly(ortho esters)—From Concept To Reality*, Biomacromolecules, vol. 5, No. 5, 2004 (pp. 1625-1632), May 9, 1979.

Schwach-Abdellaoui, et al., *Hydrolysis and Erosion Studies of Autocatalyzed Poly(ortho esters) Containing Lactoyl-Lactyl Acid Dimers*, American Chemical Society, vol. 32, No. 2, 1999 (pp. 301-307).

Ng, et al., *Synthesis and Erosion Studies of Self-Catalyzed Poly(ortho ester)s*, American Chemical Society, vol. 30, No. 4, 1997 (pp. 770-772).

Ng, et al., *Development Of A Poly(ortho ester) prototype Wih A Latent Acid In The Polymer Backbone For 5-fluorouracil Delivery*, Journal of Controlled Release 65 (2000), (pp. 367-374).
Rothen-Weinhold, et al., Release of BSA from poly(ortho ester) extruded thin strands, *Journal of Controlled Release 71*, 2001, (pp. 31-37).
Heller, et al., *Poly(ortho ester)s—their development and some recent applications*, European Journal of Pharmaceutics and Biopharmaceutics, 50, 2000, (pp. 121-128).
Heller, et al., *Poly(ortho esters); synthesis, characterization, properties and uses*, Advanced Drug Delivery Reviews, 54, 2002, (pp. 1015-1039).
Heller, et al., *Poly(ortho esters) For The Pulsed And Continuous Delivery of Peptides And Proteins*, Controlled Release and Biomedical Polymers Department, SRI International, (pp. 39-46).
Zignani, et al., *Subconjunctival biocompatibility of a viscous bioerodable poly(ortho ester)*, J. Biomed Mater Res, 39, 1998, pp. 277-285.
Toncheva, et al., *Use of Block Copolymers of Poly(Ortho Esters) and Poly (Ethylene Gylcol)*, Journal of Drug Targeting, 2003, vol. 11(6), pp. 345-353.
Schwach-Abdellaoui, et al., *Control of Molecular Weight For Auto-Catalyzed Poly(ortho ester) Obtained by Polycondensation Reaction*, International Journal of Polymer Anal. Charact., 7: 145-161, 2002, pp. 145-161.
Heller, et al., *Release of Norethindrone from Poly(Ortho Esters)*, Polymer Engineering and Science, Mid-Aug. 1991, vol. 21, No. 11 (pp. 727-731).

* cited by examiner 110
112
114
105
120
127
118
100
125
F

BIODEGRADABLE DOWNHOLE TOOLS

CROSS-REFERENCE TO RELATED APPLICATIONS

The present application is related to U.S. patent application Ser. No. 10/803,668, now U.S. Pat. No. 7,093,664 issued on Aug. 22, 2006, and entitled "One-Time Use Composite Tool Formed of Fibers and a Biodegradable Resins", which is owned by the assignee hereof, and is hereby incorporated by reference herein.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to biodegradable downhole tools and methods of removing such tools from wellbores. More particularly, the present invention relates to downhole tools or components thereof comprising an effective amount of biodegradable material such that the tool or the component desirably decomposes when exposed to a wellbore environment, and methods and systems for decomposing such downhole tools in situ.

BACKGROUND OF THE INVENTION

A wide variety of downhole tools may be used within a wellbore in connection with producing hydrocarbons or reworking a well that extends into a hydrocarbon formation. Downhole tools such as frac plugs, bridge plugs, and packers, for example, may be used to seal a component against casing along the wellbore wall or to isolate one pressure zone of the formation from another. Such downhole tools are well known in the art.

After the production or reworking operation is complete, these downhole tools must be removed from the wellbore. Tool removal has conventionally been accomplished by complex retrieval operations, or by milling or drilling the tool out of the wellbore mechanically. Thus, downhole tools are either retrievable or disposable. Disposable downhole tools have traditionally been formed of drillable metal materials such as cast iron, brass and aluminum. To reduce the milling or drilling time, the next generation of downhole tools comprises composites and other non-metallic materials, such as engineering grade plastics. Nevertheless, milling and drilling continues to be a time consuming and expensive operation. Therefore, a need exists for disposable downhole tools that are removable without being milled or drilled out of the wellbore, and for methods of removing disposable downhole tools without tripping a significant quantity of equipment into the wellbore. Further, a need exists for disposable downhole tools that are removable from the wellbore by environmentally conscious methods and systems.

SUMMARY OF THE INVENTION

The present invention relates to a disposable downhole tool or a component thereof comprising an effective amount of biodegradable material such that the tool or the component desirably decomposes when exposed to a wellbore environment. In an embodiment, the biodegradable material comprises a degradable polymer. The biodegradable material may further comprise a hydrated organic or inorganic solid compound. The biodegradable material may also be selected to achieve a desired decomposition rate when the tool is exposed to the wellbore environment. In an embodiment, the tool or component is self-degradable. In an embodiment, the disposable downhole tool further comprises an enclosure for storing a chemical solution that catalyzes decomposition of the tool or the component. The tool may also comprise an activation mechanism for releasing the chemical solution from the enclosure. In various embodiments, the disposable downhole tool comprises a frac plug, a bridge plug, a packer, or another type of wellbore zonal isolation device.

In another aspect, the present invention relates to a method for performing a downhole operation wherein a disposable downhole tool is installed within a wellbore comprising desirably decomposing the tool or a component thereof in situ via exposure to the wellbore environment. In an embodiment, the tool or a component thereof is fabricated from an effective amount of biodegradable material such that the tool or the component desirably decomposes when exposed to the wellbore environment. The method may further comprise selecting the biodegradable material to achieve a desired decomposition rate of the tool or the component. In various embodiments, the method further comprises exposing the tool or the component to an aqueous fluid before the tool is installed in the wellbore or while the tool is installed within the wellbore. In an embodiment, at least a portion of the aqueous fluid is released from a hydrated compound within the tool when the compound is exposed to the wellbore environment. The method may further comprise catalyzing decomposition of the tool or the component by applying a chemical solution onto the tool, either before, during, or after the downhole operation. In various embodiments, the chemical solution is applied to the tool by dispensing the chemical solution into the wellbore; by lowering a frangible object containing the chemical solution into the wellbore and breaking the frangible object; by extending a conduit into the wellbore and flowing the chemical solution through the conduit onto the tool; or by moving a dart within the wellbore and engaging the dart with the tool to release the chemical solution.

In yet another aspect, the present invention relates to a system for applying a chemical solution to a disposable downhole tool or a component thereof that desirably decomposes when exposed to a wellbore environment; wherein the chemical solution catalyzes decomposition of the tool or the component. The chemical may be a caustic fluid, an acidic fluid, an enzymatic fluid, an oxidizer fluid, a metal salt catalyst solution or a combination thereof. In an embodiment, the system further comprises an enclosure for containing the chemical solution. The system may also include an activation mechanism for releasing the chemical solution from the enclosure. In various embodiments, the activation mechanism may be mechanically operated, hydraulically operated, electrically operated, timer-controlled, or operated via a communication means. In various embodiments, the enclosure is disposed on the tool, lowered to the tool on a slick line, or dropped into the wellbore to engage the tool. In an embodiment, the system further comprises a conduit extending into the wellbore to apply the chemical solution onto the tool.

In still another aspect, the present invention relates to a method for desirably decomposing a disposable downhole tool or a component thereof installed within a wellbore comprising releasing water from a compound within the tool upon exposure to heat in the wellbore environment, and at least partially decomposing the tool or the component by hydrolysis.

DETAILED DESCRIPTION

Figure 1:
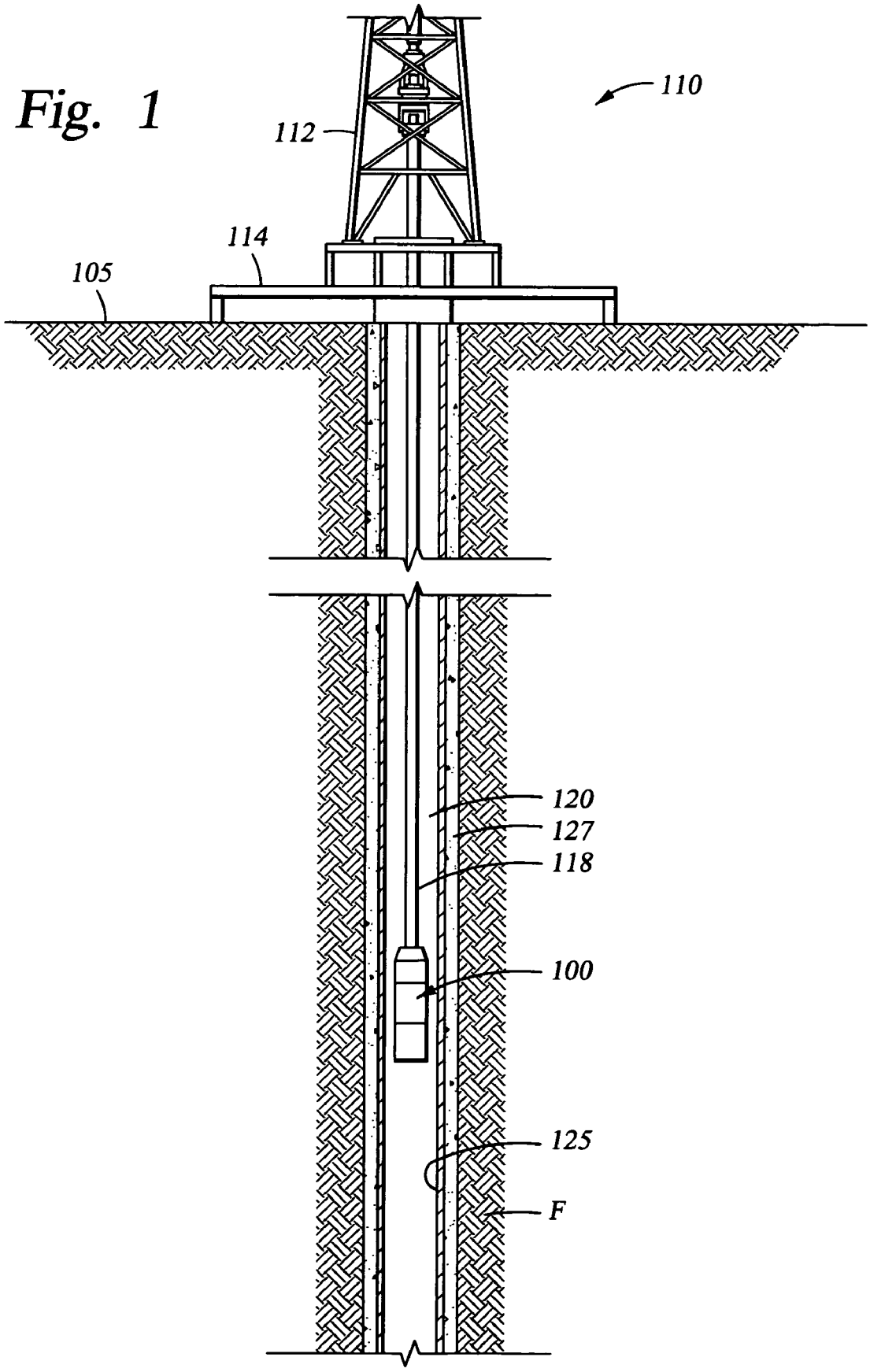
FIG. 1 is a schematic, cross-sectional view of an exemplary operating environment depicting a biodegradable downhole tool being lowered into a wellbore extending into a subterranean hydrocarbon formation.

FIG. 1 schematically depicts an exemplary operating environment for a biodegradable downhole tool 100. As depicted, a drilling rig 110 is positioned on the earth's surface 105 and extends over and around the wellbore 120 that penetrates a subterranean formation F for the purpose of recovering hydrocarbons. At least the upper portion of the wellbore 120 may be lined with casing 125 that is cemented 127 into position against the formation F in a conventional manner. The drilling rig 110 includes a derrick 112 with a rig floor 114 through which a cable 118, such as a wireline, jointed pipe, or coiled tubing, for example, extends downwardly from the drilling rig 110 into the wellbore 120. The cable 118 suspends an exemplary biodegradable downhole tool 100, which may comprise a frac plug, a bridge plug, a packer, or another type of wellbore zonal isolation device, for example, as it is being lowered to a predetermined depth within the wellbore 120 to perform a specific operation. The drilling rig 110 is conventional and therefore includes a motor driven winch and other associated equipment for extending the cable 118 into the wellbore 120 to position the tool 100 at the desired depth.

While the exemplary operating environment of FIG. 1 depicts a stationary drilling rig 110 for lowering and setting the biodegradable downhole tool 100 within the wellbore 120, one of ordinary skill in the art will readily appreciate that instead of a drilling rig 110, mobile workover rigs, well servicing units, and the like, may be used to lower the tool 100 into the wellbore 120.

Figure 2:
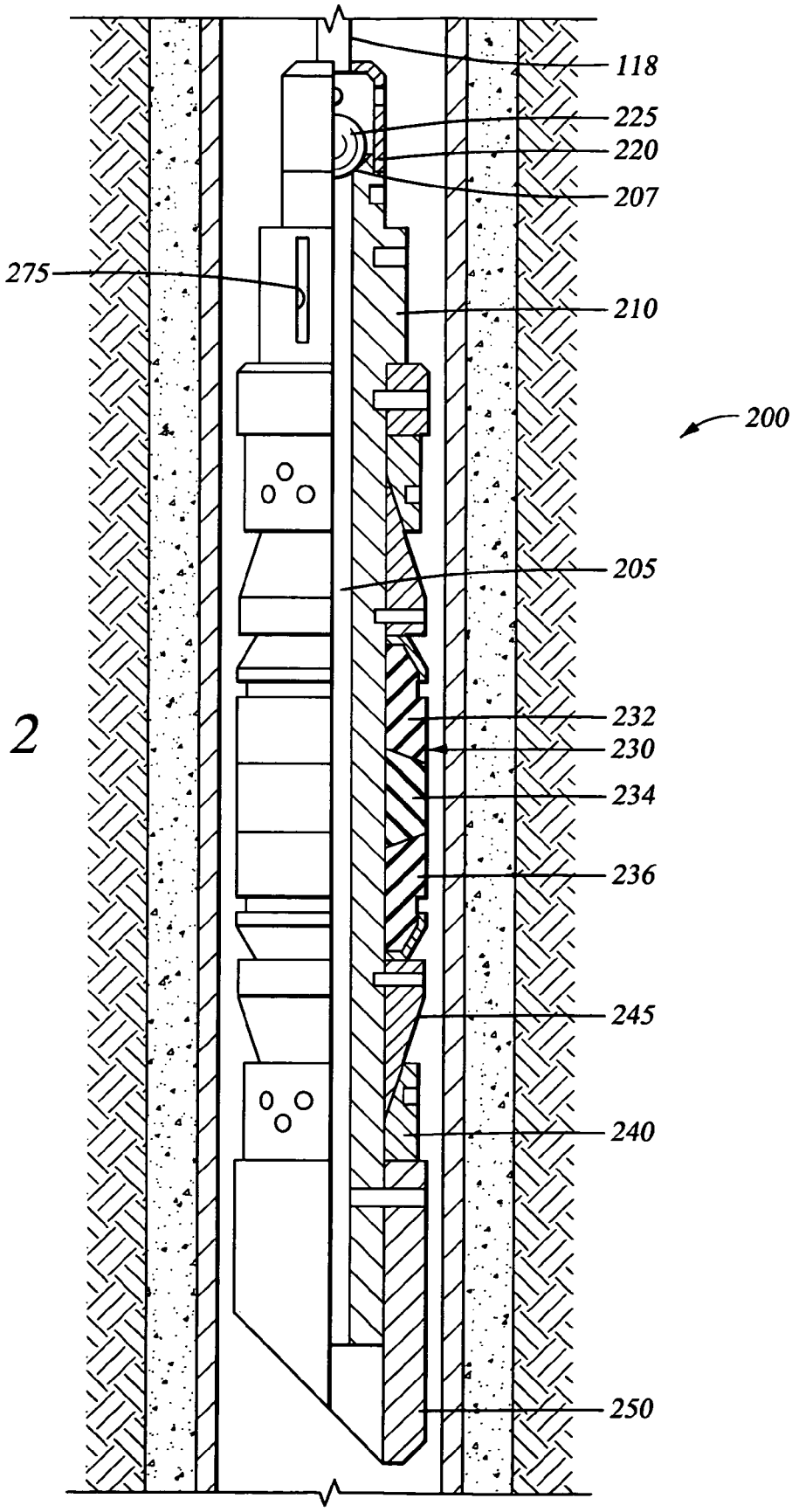
FIG. 2 is an enlarged side view, partially in cross section, of an embodiment of a biodegradable downhole tool comprising a frac plug being lowered into a wellbore.

Structurally, the biodegradable downhole tool 100 may take a variety of different forms. In an embodiment, the tool 100 comprises a plug that is used in a well stimulation/fracturing operation, commonly known as a "frac plug." FIG. 2 depicts an exemplary biodegradable frac plug, generally designated as 200, as it is being lowered into a wellbore. The frac plug 200 comprises an elongated tubular body member 210 with an axial flowbore 205 extending therethrough. A cage 220 is formed at the upper end of the body member 210 for retaining a ball 225 that acts as a one-way check valve. In particular, the ball 225 seals off the flowbore 205 to prevent flow downwardly therethrough, but permits flow upwardly through the flowbore 205. A packer element assembly 230, which may comprise an upper sealing element 232, a center sealing element 234, and a lower sealing element 236, extends around the body member 210. One or more slips 240 are mounted around the body member 210 below the packer assembly 230. The slips 240 are guided by a mechanical slip body 245. A tapered shoe 250 is provided at the lower end of the body member 210 for guiding and protecting the frac plug 200 as it is lowered into the wellbore 120. An optional enclosure 275 for storing a chemical solution may also be mounted on the body member 210 or may be formed integrally therein. In an embodiment, the enclosure 275 is formed of a frangible material.

One or more components of the frac plug 200, or portions thereof, are formed from biodegradable materials. More specifically, the frac plug 200 or a component thereof comprises an effective amount of biodegradable material such that the plug 200 or the component desirably decomposes when exposed to a wellbore environment, as further described below. In particular, the biodegradable material will decompose in the presence of an aqueous fluid in a wellbore environment. A fluid is considered to be "aqueous" herein if the fluid comprises water alone or if the fluid contains water. The biodegradable components of the frac plug 200 may be formed of any material that is suitable for service in a downhole environment and that provides adequate strength to enable proper operation of the plug 200. The particular material matrix used to form the biodegradable components of the frac plug 200 may be selected for operation in a particular pressure and temperature range, or to control the decomposition rate of the plug 200 or a component thereof. Thus, a biodegradable frac plug 200 may operate as a 30-minute plug, a three-hour plug, or a three-day plug, for example, or any other timeframe desired by the operator.

Nonlimiting examples of biodegradable materials that may form various components of the frac plug 200, or another biodegradable downhole tool 100, include but are not limited to degradable polymers. A polymer is considered to be "degradable" herein if the degradation is due to, inter alia, chemical and/or radical process such as hydrolysis, oxidation, or UV radiation. The degradability of a polymer depends at least in part on its backbone structure. For instance, the presence of hydrolyzable and/or oxidizable linkages in the backbone often yields a material that will degrade as described herein. The rates at which such polymers degrade are dependent on the type of repetitive unit, composition, sequence, length, molecular geometry, molecular weight, morphology (e.g., crystallinity, size of spherulites, and orientation), hydrophilicity, hydrophobicity, surface area, and additives. Also, the environment to which the polymer is subjected may affect how it degrades, e.g., temperature, presence of moisture, oxygen, microorganisms, enzymes, pH, and the like.

Suitable examples of degradable polymers that may form various components of the disposable downhole tools 100 include but are not limited to those described in the publication of Advances in Polymer Science, Vol. 157 entitled "Degradable Aliphatic Polyesters" edited by A. C. Albertsson. Specific examples include homopolymers, random, block, graft, and star- and hyper-branched aliphatic polyesters. Polycondensation reactions, ring-opening polymerizations, free radical polymerizations, anionic polymerizations, carbocationic polymerizations, coordinative ring-opening polymerization, and any other suitable process may prepare such suitable polymers. Specific examples of suitable polymers include polysaccharides such as dextran or cellulose; chitin; chitosans; proteins; aliphatic polyesters; poly(lactides); poly(glycolides); poly(ϵ-caprolactones); poly(hydroxybutyrates); poly(anhydrides); aliphatic polycarbonates; poly(orthoesters); poly(amino acids); poly(ethylene oxides); and polyphosphazenes. Of these suitable polymers, aliphatic polyesters and polyanhydrides are preferred.

Aliphatic polyesters degrade chemically, inter alia, by hydrolytic cleavage. Hydrolysis can be catalyzed by either acids or bases. Generally, during the hydrolysis, carboxylic end groups are formed during chain scission, and this may enhance the rate of further hydrolysis. This mechanism is known in the art as "autocatalysis," and is thought to make polyester matrices more bulk eroding.

Suitable aliphatic polyesters have the general formula of repeating units shown below:

Formula I

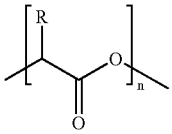

where n is an integer between 75 and 10,000 and R is selected from the group consisting of hydrogen, alkyl, aryl, alkylaryl, acetyl, heteroatoms, and mixtures thereof. Of the suitable aliphatic polyesters, poly(lactide) is preferred. Poly (lactide) is synthesized either from lactic acid by a condensation reaction or more commonly by ring-opening polymerization of cyclic lactide monomer. Since both lactic acid and lactide can achieve the same repeating unit, the general term poly(lactic acid) as used herein refers to Formula I without any limitation as to how the polymer was made such as from lactides, lactic acid, or oligomers, and without reference to the degree of polymerization or level of plasticization.

The lactide monomer exists generally in three different forms: two stereoisomers L- and D-lactide and racemic D,L-lactide (meso-lactide). The oligomers of lactic acid, and oligomers of lactide are defined by the formula:

Formula II

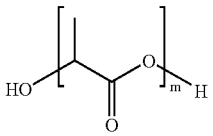

where m is an integer: $2 \leqq m \leqq 75$. Preferably m is an integer: $2 \leqq m \leqq 10$. These limits correspond to number average molecular weights below about 5,400 and below about 720, respectively. The chirality of the lactide units provides a means to adjust, inter alia, degradation rates, as well as physical and mechanical properties. Poly(L-lactide), for instance, is a semicrystalline polymer with a relatively slow hydrolysis rate. This could be desirable in downhole operations where a slower degradation of the degradable material is desired. Poly(D,L-lactide) may be a more amorphous polymer with a resultant faster hydrolysis rate. This may be suitable for other downhole operations where a more rapid degradation may be appropriate. The stereoisomers of lactic acid may be used individually or combined in accordance with the present invention. Additionally, they may be copolymerized with, for example, glycolide or other monomers like ϵ-caprolactone, 1,5-dioxepan-2-one, trimethylene carbonate, or other suitable monomers to obtain polymers with different properties or degradation times. Additionally, the lactic acid stereoisomers can be modified by blending, copolymerizing or otherwise mixing high and low molecular weight polylactides; or by blending, copolymerizing or otherwise mixing a polylactide with another polyester or polyesters.

Plasticizers may also be present in the polymeric degradable materials comprising the disposable downhole tools 100. Suitable plasticizers include but are not limited to derivatives of oligomeric lactic acid, selected from the group defined by the formula:

Formula III

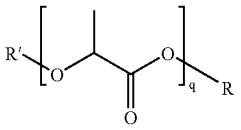

where R is a hydrogen, alkyl, aryl, alkylaryl, acetyl, heteroatom, or a mixture thereof and R is saturated, where R' is a hydrogen, alkyl, aryl, alkylaryl, acetyl, heteroatom, or a mixture thereof and R' is saturated, where R and R' cannot both be hydrogen, where q is an integer: $2 \leqq q \leqq 75$; and mixtures thereof. Preferably q is an integer: $2 \leqq q \leqq 10$. As used herein the term "derivatives of oligomeric lactic acid" includes derivatives of oligomeric lactide.

The plasticizers may be present in any amount that provides the desired characteristics. For example, the various types of plasticizers discussed herein provide for (a) more effective compatibilization of the melt blend components; (b) improved processing characteristics during the blending and processing steps; and (c) control and regulate the sensitivity and degradation of the polymer by moisture. For pliability, plasticizer is present in higher amounts while other characteristics are enhanced by lower amounts. The compositions allow many of the desirable characteristics of pure nondegradable polymers. In addition, the presence of plasticizer facilitates melt processing, and enhances the degradation rate of the compositions in contact with the wellbore environment. The intimately plasticized composition should be processed into a final product in a manner adapted to retain the plasticizer as an intimate dispersion in the polymer for certain properties. These can include: (1) quenching the composition at a rate adapted to retain the plasticizer as an intimate dispersion; (2) melt processing and quenching the composition at a rate adapted to retain the plasticizer as an intimate dispersion; and (3) processing the composition into a final product in a manner adapted to maintain the plasticizer as an intimate dispersion. In certain preferred embodiments, the plasticizers are at least intimately dispersed within the aliphatic polyester.

A preferred aliphatic polyester is poly(lactic acid). D-lactide is a dilactone, or cyclic dimer, of D-lactic acid. Similarly, L-lactide is a cyclic dimer of L-lactic acid. Meso D,L-lactide is a cyclic dimer of D-, and L-lactic acid. Racemic D,L-lactide comprises a 50/50 mixture of D-, and L-lactide. When used alone herein, the term "D,L-lactide" is intended to include meso D,L-lactide or racemic D,L-lactide. Poly(lactic acid) may be prepared from one or more of the above. The chirality of the lactide units provides a means to adjust degradation rates as well as physical and mechanical properties. Poly(L-lactide), for instance, is a semicrystalline polymer with a relatively slow hydrolysis rate. Poly (D,L-lactide) is an amorphous polymer with a faster hydrolysis rate. The stereoisomers of lactic acid may be used individually combined or copolymerized in accordance with the present invention.

The aliphatic polyesters may be prepared by substantially any of the conventionally known manufacturing methods such as those described in U.S. Pat. Nos. 6,323,307; 5,216,050; 4,387,769; 3,912,692; and 2,703,316, which are hereby incorporated herein by reference in their entirety.

Poly(anhydrides) are another type of particularly suitable degradable polymer useful in the disposable downhole tools 100. Poly(anhydride) hydrolysis proceeds, inter alia, via free carboxylic acid chain-ends to yield carboxylic acids as final degradation products. The erosion time can be varied over a broad range of changes in the polymer backbone. Examples of suitable poly(anhydrides) include poly(adipic anhydride), poly(suberic anhydride), poly(sebacic anhydride), and poly (dodecanedioic anhydride). Other suitable examples include but are not limited to poly(maleic anhydride) and poly (benzoic anhydride).

The physical properties of degradable polymers depend on several factors such as the composition of the repeat units, flexibility of the chain, presence of polar groups, molecular mass, degree of branching, crystallinity, orientation, etc. For example, short chain branches reduce the degree of crystallinity of polymers while long chain branches lower the melt viscosity and impart, inter alia, elongational viscosity with tension-stiffening behavior. The properties of the material utilized can be further tailored by blending, and copolymerizing it with another polymer, or by a change in the macromolecular architecture (e.g., hyperbranched polymers, star-shaped, or dendrimers, etc.). The properties of any such suitable degradable polymers (e.g., hydrophobicity, hydrophilicity, rate of degradation, etc.) can be tailored by introducing select functional groups along the polymer chains. For example, poly(phenyllactide) will degrade at about ⅕th of the rate of racemic poly(lactide) at a pH of 7.4 at 55° C. One of ordinary skill in the art with the benefit of this disclosure will be able to determine the appropriate functional groups to introduce to the polymer chains to achieve the desired physical properties of the degradable polymers.

In various embodiments, the frac plug 200 or a component thereof is self-degradable. Namely, the frac plug 200, or portions thereof, are formed from biodegradable materials comprising a mixture of a degradable polymer, such as the aliphatic polyesters or poly(anhydrides) previously described, and a hydrated organic or inorganic solid compound. The degradable polymer will at least partially degrade in the releasable water provided by the hydrated organic or inorganic compound, which dehydrates over time when heated due to exposure to the wellbore environment.

Examples of the hydrated organic or inorganic solid compounds that can be utilized in the self-degradable frac plug 200 or self-degradable component thereof include, but are not limited to, hydrates of organic acids or their salts such as sodium acetate trihydrate, L-tartaric acid disodium salt dihydrate, sodium citrate dihydrate, hydrates of inorganic acids or their salts such as sodium tetraborate decahydrate, sodium hydrogen phosphate heptahydrate, sodium phosphate dodecahydrate, amylose, starch-based hydrophilic polymers, and cellulose-based hydrophilic polymers. Of these, sodium acetate trihydrate is preferred.

Figure 3:
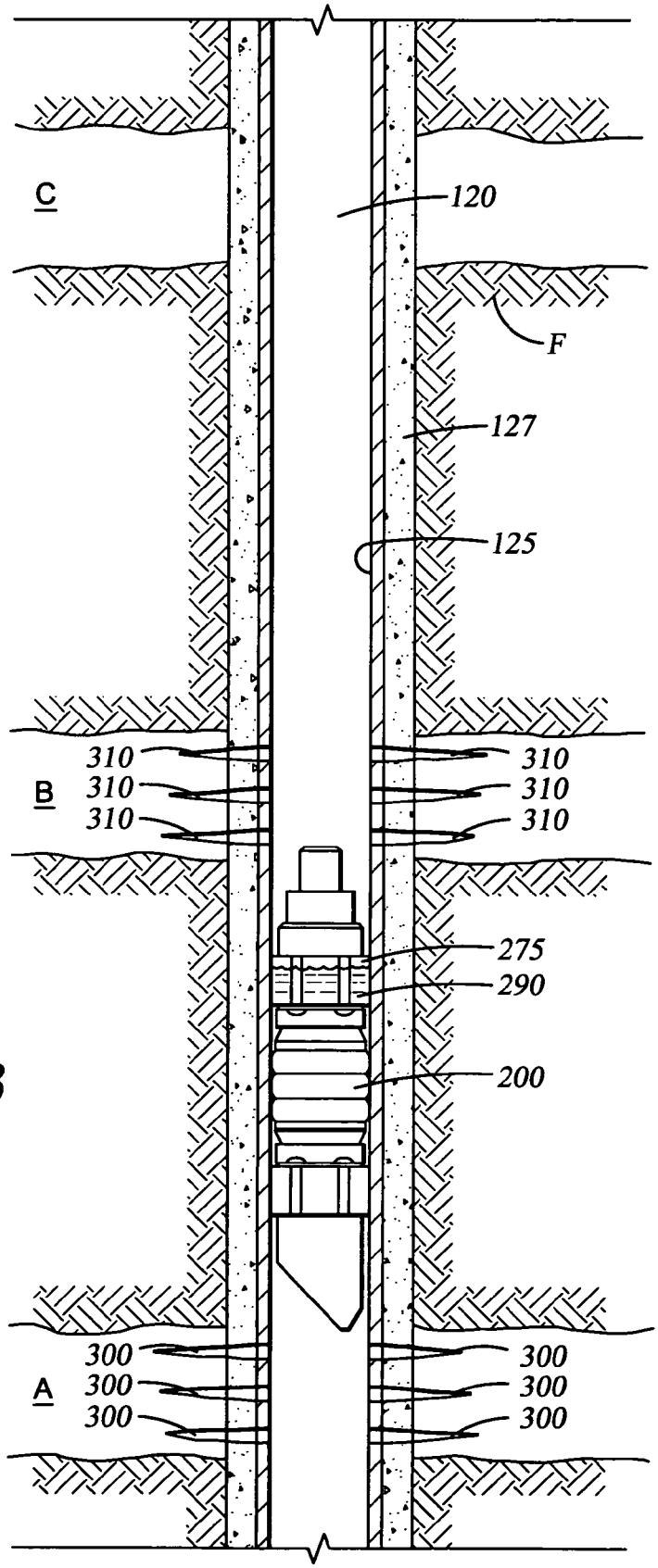
FIG. 3 is an enlarged cross-sectional side view of a wellbore having a representative biodegradable downhole tool with an optional enclosure installed therein.

In operation, the frac plug 200 of FIG. 2 may be used in a well stimulation/fracturing operation to isolate the zone of the formation F below the plug 200. Referring now to FIG. 3, the frac plug 200 is shown disposed between producing zone A and producing zone B in the formation F. In a conventional well stimulation/fracturing operation, before setting the frac plug 200 to isolate zone A from zone B, a plurality of perforations 300 are made by a perforating tool (not shown) through the casing 125 and cement 127 to extend into producing zone A. Then a well stimulation fluid is introduced into the wellbore 120, such as by lowering a tool (not shown) into the wellbore 120 for discharging the fluid at a relatively high pressure or by pumping the fluid directly from the drilling rig 110 into the wellbore 120. The well stimulation fluid passes through the perforations 300 into producing zone A of the formation F for stimulating the recovery of fluids in the form of oil and gas containing hydrocarbons. These production fluids pass from zone A, through the perforations 300, and up the wellbore 120 for recovery at the drilling rig 110.

The frac plug 200 is then lowered by the cable 118 to the desired depth within the wellbore 120, and the packer element assembly 230 is set against the casing 125 in a conventional manner, thereby isolating zone A as depicted in FIG. 3. Due to the design of the frac plug 200, the ball 225 within cage 220 will unseal the flowbore 205, such as by unseating from the upper surface 207 of the flowbore 205, for example, to allow fluid from isolated zone A to flow upwardly through the frac plug 200. However, the ball 225 will seal off the flowbore 205, such as by seating against the upper surface 207 of the flowbore 205, for example, to prevent flow downwardly into the isolated zone A. Accordingly, the production fluids from zone A continue to pass through the perforations 300, into the wellbore 120, and upwardly through the flowbore 205 of the frac plug 200, before flowing into the wellbore 120 above the frac plug 200 for recovery at the rig 110.

After the frac plug 200 is set into position as shown in FIG. 3, a second set of perforations 310 may then be formed through the casing 125 and cement 127 adjacent intermediate producing zone B of the formation F. Zone B is then treated with well stimulation fluid, causing the recovered fluids from zone B to pass through the perforations 310 into the wellbore 120. In this area of the wellbore 120 above the frac plug 200, the recovered fluids from zone B will mix with the recovered fluids from zone A before flowing upwardly within the wellbore 120 for recovery at the drilling rig 110.

If additional well stimulation/fracturing operations will be performed, such as recovering hydrocarbons from zone C, additional frac plugs 200 may be installed within the wellbore 120 to isolate each zone of the formation F. Each frac plug 200 allows fluid to flow upwardly therethrough from the lowermost zone A to the uppermost zone C of the formation F, but pressurized fluid cannot flow downwardly through the frac plug 200.

After the fluid recovery operations are complete, the frac plug 200 must be removed from the wellbore 120. In this context, as stated above, at least some components of the frac plug 200, or portions thereof, are formed from biodegradable materials. More specifically, the frac plug 200 or a component thereof comprises an effective amount of biodegradable material such that the plug 200 or the component desirably decomposes when exposed to a wellbore environment. In particular, these biodegradable materials will decompose in the presence of an aqueous fluid in a wellbore environment. A fluid is considered to be "aqueous" herein if the fluid comprises water alone or if the fluid contains water. Aqueous fluids may be present naturally in the wellbore 120, or may be introduced to the wellbore 120 before, during, or after downhole operations. Alternatively, the frac plug 200 may be exposed to an aqueous fluid prior to being installed within the wellbore 120. Further, for those embodiments of the frac plug 200 or a component thereof that are self-degradable, an aqueous fluid is released by the hydrated organic or inorganic solid compound as it dehydrates over time when heated in the wellbore environment. Thus, the self-degradable frac plug 200 or component thereof is suitable for use in a non-aqueous wellbore environment.

Accordingly, in an embodiment, the frac plug 200 is designed to decompose over time while operating in a wellbore environment, thereby eliminating the need to mill or drill the frac plug 200 out of the wellbore 120. Thus, by exposing the biodegradable frac plug 200 to wellbore temperatures and an aqueous fluid, at least some of its components will decompose, causing the frac plug 200 to lose structural and/or functional integrity and release from the casing 125. The remaining components of the plug 200 will simply fall to the bottom of the wellbore 120. In various alternate embodiments, degrading one or more components of a downhole tool 100 performs an actuation function, opens a passage, releases a retained member, or otherwise changes the operating mode of the downhole tool 100.

In choosing the appropriate biodegradable materials for the frac plug 200 or a component thereof, one should consider the degradation products that will result. These degradation products should not adversely affect other operations or components. The choice of biodegradable materials also can depend, at least in part, on the conditions of the well, e.g., wellbore temperature. While no upper temperature limit is known to exist, lactides have been found to be suitable for lower temperature wells, including those within the range of 60° F. to 150° F., and polylactides have been found to be suitable for wellbore temperatures above this range. Also, poly(lactic acid) may be suitable for higher temperature wells in the range of from about 350° F. to 500° F. Some stereoisomers of poly(lactide) or mixtures of such stereoisomers may be suitable for even higher temperature applications. In certain embodiments, the subterranean formation F has a temperature above about 180° F., and self-degradable frac plugs 200 are most suitable for use where the formation F has a temperature in excess of about 200° F. to facilitate release of the water in the hydrated organic or inorganic compound.

As stated above, the biodegradable material forming components of the frac plug 200 may be selected to control the decomposition rate of the plug 200 or a component thereof. However, in some cases, it may be desirable to catalyze decomposition of the frac plug 200 or the component by applying a chemical solution to the plug 200. The chemical solution comprises a caustic fluid, an acidic fluid, an enzymatic fluid, an oxidizer fluid, a metal salt catalyst solution or a combination thereof, and may be applied before or after the frac plug 200 is installed within the wellbore 120. Further, the chemical solution may be applied before, during, or after the fluid recovery operations. For those embodiments where the chemical solution is applied before or during the fluid recovery operations, the biodegradable material, the chemical solution, or both may be selected to ensure that the frac plug 200 or a component thereof decomposes over time while remaining intact during its intended service.

The chemical solution may be applied by means internal to or external to the frac plug 200. In an embodiment, an optional enclosure 275 is provided on the frac plug 200 for storing the chemical solution 290 as depicted in FIG. 3. An activation mechanism, such as a slideable valve, for example, may be provided to release the chemical solution 290 from the optional enclosure 275 onto the frac plug 200. This activation mechanism may be timer-controlled or operated mechanically, hydraulically, electrically, or via a communication means, such as a wireless signal, for example. This embodiment would be advantageous for fluid recovery operations using more than one frac plug 200, since the activation mechanism for each plug 200 could be actuated as desired to release the chemical solution 290 from the enclosure 275 so as to decompose each plug 200 at the appropriate time with respect to the fluid recovery operations.

Figure 4A:
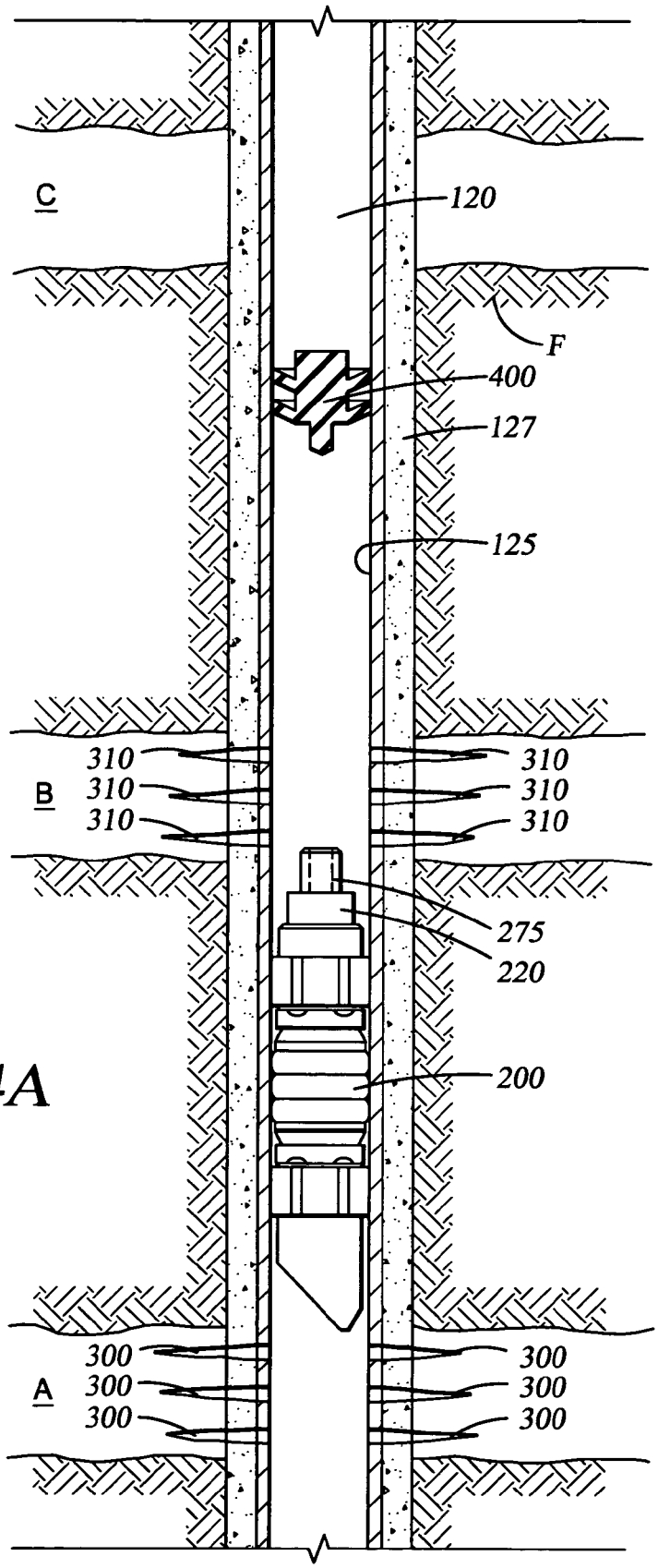
FIG. 4A is an enlarged cross-sectional side view of a wellbore with a biodegradable downhole tool installed therein and with a pumpable dart moving in the wellbore toward the tool.

As depicted in FIG. 4A, in another embodiment, a pumpable dart 400 releases the chemical solution 290 onto the frac plug 200. As depicted, the pumpable dart 400 engages and seals against the casing 125 within the wellbore 120. Therefore, fluid must be pumped into the wellbore 120 behind the dart 400 to force the pumpable dart 400 to move within the wellbore 120. In one embodiment, the optional enclosure 275 on the frac plug 200 is positioned above the cage 220 on the uppermost end of the frac plug 200, and the pumpable dart 400 is moved by fluid pressure within the wellbore 120 to engage the enclosure 275. In an embodiment, the pumpable dart 400 actuates the activation mechanism to mechanically release the chemical solution from the enclosure 275 onto the frac plug 200. In another embodiment, the optional enclosure 275 is frangible, and the pumpable dart 400 engages the enclosure 275 with enough force to break it, thereby releasing the chemical solution onto the frac plug 200. In yet another embodiment, the chemical solution is stored within the pumpable dart 400, which is frangible. In this embodiment, the pumpable dart 400 is moved by fluid pressure within the wellbore 120 and engages the frac plug 200 with enough force to break the dart 400, thereby releasing the chemical solution onto the plug 200.

Figure 4B:
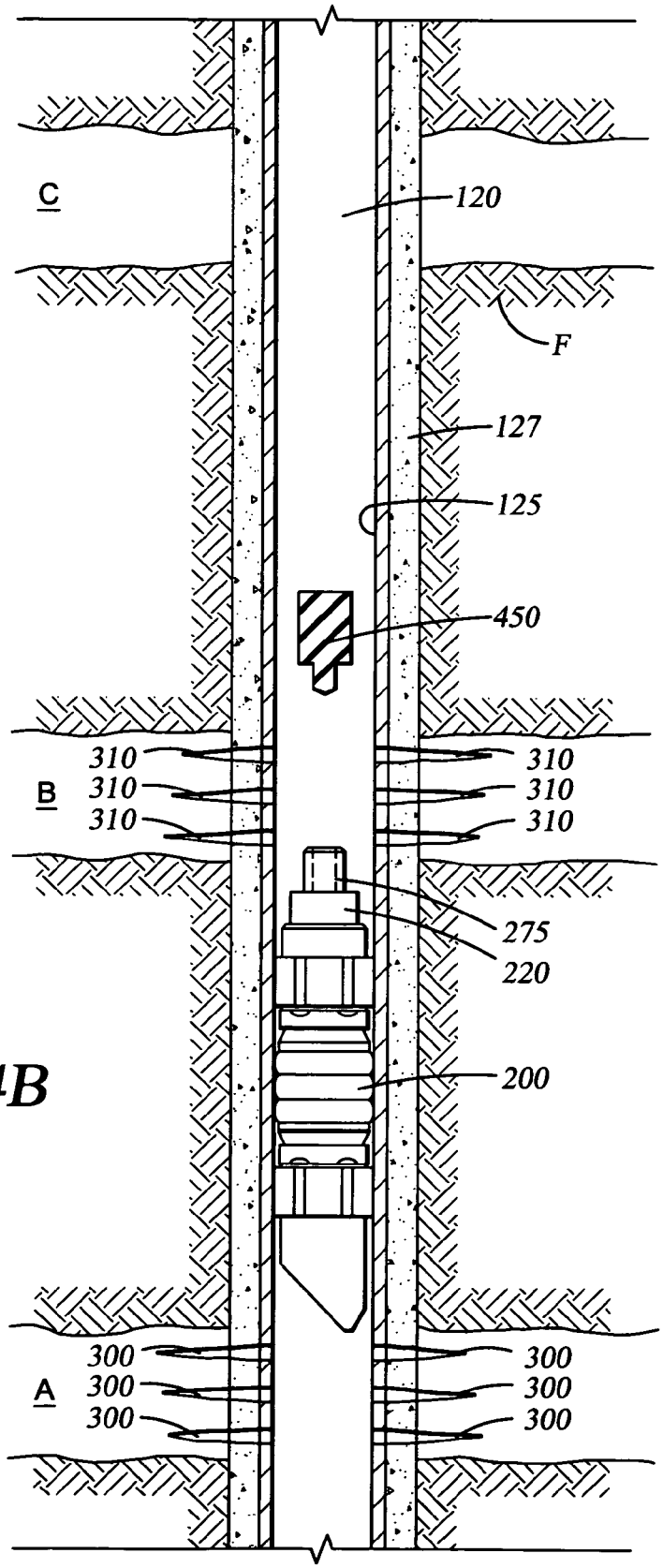
FIG. 4B is an enlarged cross-sectional side view of a wellbore with a biodegradable downhole tool installed therein and with a gravity dart moving in the wellbore toward the tool.

As depicted in FIG. 4B, in another embodiment, a gravity dart 450 may be used to release the chemical solution 290 onto the frac plug 200. Unlike the pumpable dart 400, the gravity dart 450 does not engage or seal against the casing 125 within the wellbore 120, and fluid flow is not required to move the dart 450 within the wellbore 120. Instead, the gravity dart 450 moves by free falling within the wellbore 120. The various embodiments and methods of using the pumpable dart 400 to release the chemical solution 290 onto the frac plug 200, as described above, apply also to the gravity dart 450.

Figure 5:
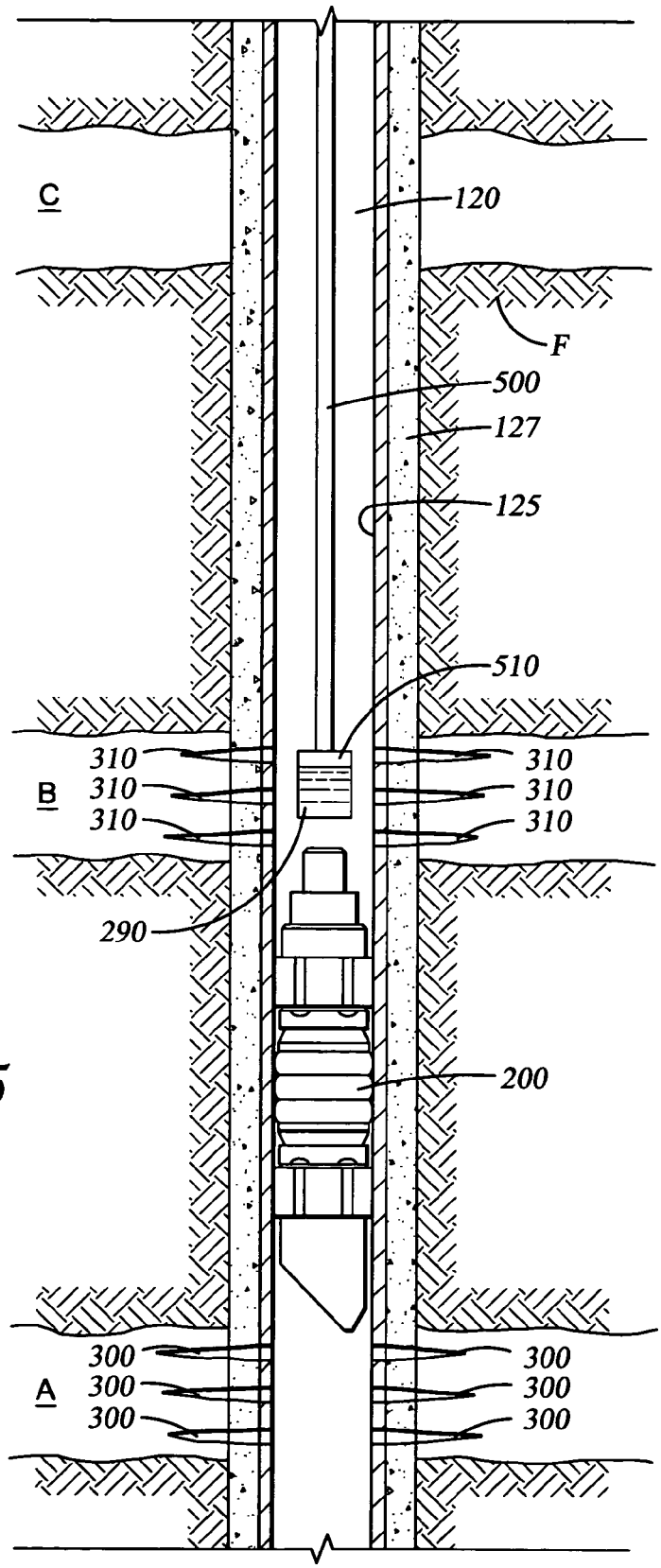
FIG. 5 is an enlarged cross-sectional side view of a wellbore with a biodegradable downhole tool installed therein and with a line lowering a frangible object containing chemical solution towards the tool.

Referring now to FIG. 5, in another embodiment, a slick line 500 may be used to lower a container 510 filled with chemical solution 290 adjacent the frac plug 200 to release the chemical solution 290 onto the plug 200. In an embodiment, the container 510 is frangible and is broken upon engagement with the frac plug 200 to release the chemical solution 290 onto the plug 200. In various other embodiments, the chemical solution 290 may be released from the container 510 via a timer-controlled operation, a mechanical operation, a hydraulic operation, an electrical operation, or via a communication means, such as a wireless signal, for example.

Figure 6:
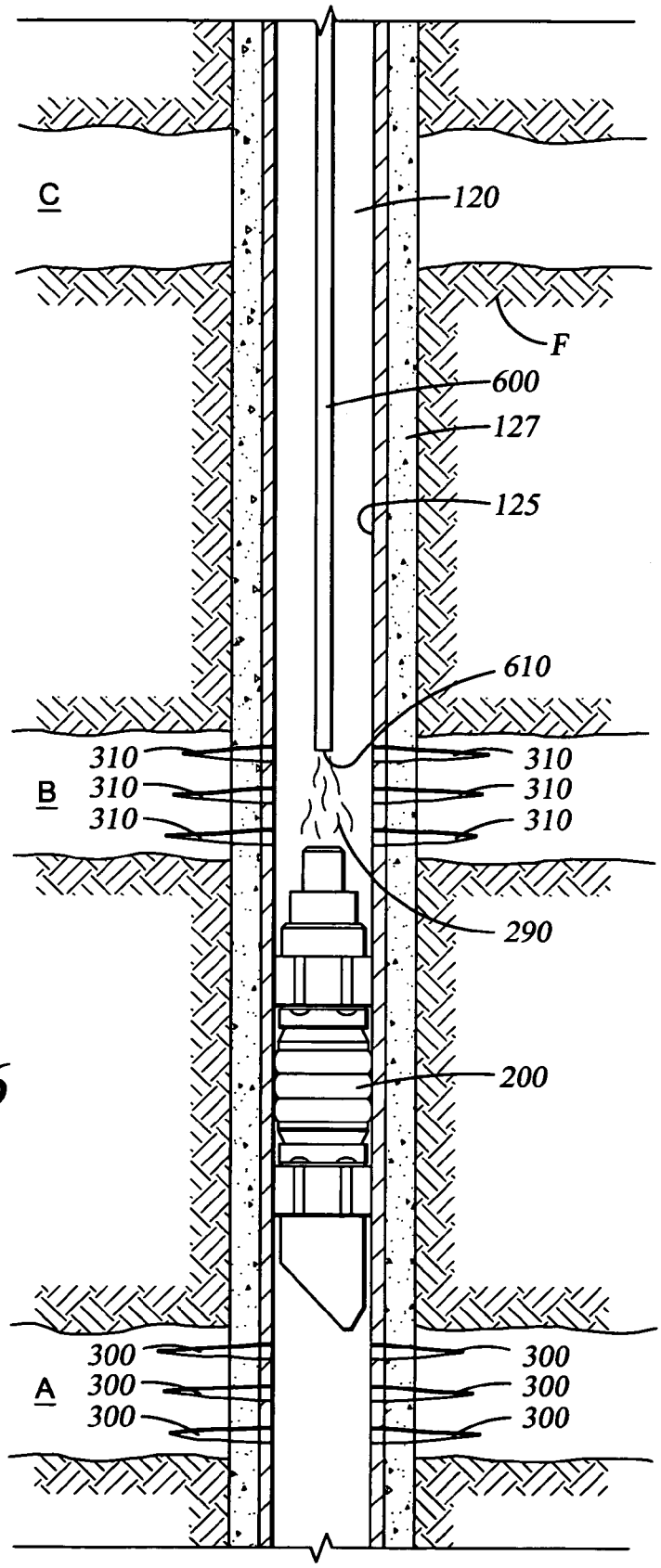
FIG. 6 is an enlarged cross-sectional side view of a wellbore with a biodegradable downhole tool installed therein and with a conduit extending towards the tool to dispense chemical solution.

FIG. 6 depicts another embodiment of a system for applying a chemical solution 290 to the frac plug 200 comprising a conduit 600, such as a coiled tubing or work string, that extends into the wellbore 120 to a depth where the terminal end 610 of the conduit 600 is adjacent the frac plug 200. Chemical solution 290 may then flow downwardly through the conduit 600 to spot the chemical solution 290 onto the frac plug 200. Alternatively, if the chemical solution 290 is more dense than the other fluids in the wellbore 120, the chemical solution 290 could be dispensed by injecting it directly into the wellbore 120 at the drilling rig 110 to flow downwardly to the frac plug 200 without using conduit 600. In another embodiment, the chemical solution 290 may be dispensed into the wellbore 120 during fluid recovery operations. In a preferred embodiment, the fluid that is circulated into the wellbore 120 during the downhole operation comprises both the aqueous fluid and the chemical solution 290 to decompose the frac plug 200 or a component thereof.

Removing a biodegradable downhole tool 100, such as the frac plug 200 described above, from the wellbore 120 is more cost effective and less time consuming than removing conventional downhole tools, which requires making one or more trips into the wellbore 120 with a mill or drill to gradually grind or cut the tool away. Further, biodegradable downhole tools 100 are removable, in most cases, by simply exposing the tools 100 to a naturally occurring downhole environment over time. The foregoing descriptions of specific embodiments of the biodegradable tool 100, and the systems and methods for removing the biodegradable tool 100 from the wellbore 120 have been presented for purposes of illustration and description and are not intended to be exhaustive or to limit the invention to the precise forms disclosed. Obviously many other modifications and variations are possible. In particular, the type of biodegradable downhole tool 100, or the particular components that make up the downhole tool 100 could be varied. For example, instead of a frac plug 200, the biodegradable downhole tool 100 could comprise a bridge plug, which is designed to seal the wellbore 120 and isolate the zones above and below the bridge plug, allowing no fluid communication in either direction. Alternatively, the biodegradable downhole tool 100 could comprise a packer that includes a shiftable valve such that the packer may perform like a bridge plug to isolate two formation zones, or the shiftable valve may be opened to enable fluid communication therethrough.

While various embodiments of the invention have been shown and described herein, modifications may be made by one skilled in the art without departing from the spirit and the teachings of the invention. The embodiments described here are exemplary only, and are not intended to be limiting. Many variations, combinations, and modifications of the invention disclosed herein are possible and are within the scope of the invention. Accordingly, the scope of protection is not limited by the description set out above, but is defined by the claims which follow, that scope including all equivalents of the subject matter of the claims.

What is claimed is:

1. A disposable downhole tool or a component thereof comprising an effective amount of biodegradable material such that the tool or the component desirably decomposes when exposed to a well bore environment; wherein the biodegradable material comprises a degradable polymer comprising one or more compounds selected from the group consisting of polysaccharides, chitin, chitosans, poly(ethylene oxides), poly(phenyllactide), and polyphosphazenes, and wherein the tool comprises a frac plug, a bridge plug, or a packer.

2. The disposable downhole tool or the component thereof of claim 1 wherein the degradable polymer further comprises an aliphatic polyester.

3. The disposable downhole tool or the component thereof of claim 2 wherein the aliphatic polyester comprises a polylactide.

4. The disposable downhole tool or the component thereof of claim 3 wherein the polylactide comprises poly(L-lactide), poly(D-lactide), poly(D,L-lactide), or combinations thereof.

5. The disposable downhole tool or the component thereof of claim 1 wherein the degradable polymer further comprises polyanhydrides.

6. The disposable downhole tool or the component thereof of claim 1 wherein the biodegradable material further comprises one or more compounds selected from the group consisting of poly(adipic anhydride), poly(suberic anhydride), poly(sebacic anhydride), poly(dodecanedioic anhydride), poly(maleic anhydride), and poly(benzoic anhydride).

7. The disposable downhole tool or the component thereof of claim 1 further comprising plasticizers.

8. The disposable downhole tool or the component thereof of claim 7 wherein the plasticizers comprise derivatives of oligomeric lactic acid.

9. The disposable downhole tool or the component thereof of claim 1 wherein the biodegradable material further comprises poly(lactic acid).

10. The biodegradable downhole tool or the component thereof of claim 1 wherein the biodegradable material is selected to achieve a desired decomposition rate when the tool is exposed to the well bore environment.

11. The disposable downhole tool or the component thereof of claim 1 wherein the well bore environment comprises an aqueous fluid.

12. The disposable downhole tool or the component thereof of claim 1 wherein the tool or the component is self-degradable.

13. The disposable downhole tool or the component thereof of claim 12 wherein the well bore environment comprises a well bore temperature of at least about 200 degrees Fahrenheit.

14. The disposable downhole tool or the component thereof of claim 1 wherein the decomposition is due to hydrolysis.

15. The disposable tool or the component thereof of claim 1 wherein the decomposition comprises loss of structural integrity of the tool or the component.

16. The disposable tool or the component thereof of claim 1 wherein the decomposition comprises loss of functional integrity of the tool or the component.

17. The disposable tool or the component thereof of claim 1 wherein the tool or the component decomposes within about a predetermined amount of time.

18. The disposable downhole tool or the component thereof of claim 1 wherein the decomposition of the biodegradable composition is catalyzed by a chemical solution.

19. The disposable downhole tool or the component thereof of claim 18 wherein the chemical solution is applied to the disposable downhole tool or the component thereof by moving a dart within the well bore and engaging the dart with the tool to release the chemical solution.

20. The disposable downhole tool or the component thereof of claim 18 wherein the chemical solution is applied to the disposable downhole tool or the component thereof by releasing the chemical solution from storage integral to the tool.

21. The disposable downhole tool or the component thereof of claim 18 wherein the chemical solution is applied to the disposable downhole tool or the component thereof by releasing the chemical solution from storage external to the tool.

22. The disposable downhole tool or the component thereof of claim 18 wherein the chemical solution is applied to the disposable downhole tool or the component thereof by dispensing the chemical solution into the well bore.

23. A disposable downhole tool or a component thereof comprising an effective amount of biodegradable material such that the tool or the component desirably decomposes when exposed to a well bore environment; wherein the biodegradable material comprises a degradable polymer comprising one or more compounds selected from the group consisting of polysaccharides, chitin, chitosans, poly(ethylene oxides) poly(phenyllactide), and polyphosphazenes, and further comprising a hydrated organic or inorganic solid compound.

24. The disposable downhole tool or the component thereof of claim 23 wherein the hydrated organic or inorganic solid compound comprises hydrates of organic acids or organic acid salts.

25. The disposable downhole tool or the component thereof of claim 23 wherein the hydrated organic or inorganic solid compound comprises one or more compounds selected from the group consisting of: sodium acetate trihydrate, L-tartaric acid disodium salt dihydrate, sodium citrate dihydrate, sodium tetraborate decahydrate, sodium hydrogen phosphate heptahydrate, sodium phosphate dodecahydrate, amylose, starch-based hydrophilic polymers, and cellulose-based hydrophilic polymers.

26. A disposable downhole tool or a component thereof comprising an effective amount of biodegradable material such that the tool or the component desirably decomposes when exposed to a well bore environment; wherein the biodegradable material comprises a degradable polymer comprising one or more compounds selected from the group consisting of polysaccharides, chitin, chitosans, poly(ethylene oxides), poly(phenyllactide), and polyphosphazenes, and wherein the biodegradable material further comprises an aliphatic polyester and sodium acetate trihydrate.

27. A disposable downhole tool or a component thereof comprising an effective amount of biodegradable material such that the tool or the component desirably decomposes when exposed to a well bore environment; wherein the biodegradable material comprises a degradable polymer comprising one or more compounds selected from the group consisting of polysaccharides, chitin, chitosans, poly(ethylene oxides) poly(phenyllactide), and polyphosphazenes, and wherein the biodegradable material further comprises a polyanhydride and sodium acetate trihydrate.

28. A disposable downhole tool or a component thereof comprising an effective amount of biodegradable material such that the tool or the component desirably decomposes when exposed to a well bore environment; wherein the biodegradable material comprises a degradable polymer comprising one or more compounds selected from the group consisting of polysaccharides, chitin, chitosans, poly(ethylene oxides) poly(phenyllactide), and polyphosphazenes, and further comprising an enclosure for storing a chemical solution that catalyzes decomposition.

29. The disposable downhole tool or the component thereof of claim 28 wherein the chemical solution comprises: a caustic fluid, an acidic fluid, an enzymatic fluid, an oxidizer fluid, a metal salt catalyst solution or a combination thereof.

30. The disposable downhole tool or the component thereof of claim 28 further comprising an activation mechanism for releasing the chemical solution from the enclosure.

31. The disposable downhole tool or the component thereof of claim 30 wherein the activation mechanism comprises a frangible enclosure body.

32. The disposable downhole tool or the component thereof of claim 30 wherein the activation mechanism is timer-controlled.

33. The disposable downhole tool or the component thereof of claim 30 wherein the activation mechanism is mechanically operated.

34. The disposable downhole tool or the component thereof of claim 30 wherein the activation mechanism is hydraulically operated.

35. The disposable downhole tool or the component thereof of claim 30 wherein the activation mechanism is electrically operated.

36. The disposable downhole tool or the component thereof of claim 30 wherein the activation mechanism is operated by a communication means.

37. A method for performing a downhole operation wherein a disposable downhole tool is installed within a well bore comprising: desirably decomposing the tool or a component thereof in situ via exposure to the well bore environment; wherein the tool comprises a frac plug, a bridge plug, or a packer fabricated from a biodegradable material and wherein the biodegradable material comprises a degradable polymer; catalyzing decomposition of the tool or the component thereof by applying a chemical solution to the tool or the component thereof; moving a dart within the well bore; and engaging the dart with the tool to release the chemical solution.

38. The method of claim 37 further comprising selecting the biodegradable material to achieve a desired decomposition rate of the tool or the component thereof.

39. The method of claim 37 further comprising exposing the tool or the component thereof to an aqueous fluid.

40. The method of claim 39 wherein at least a portion of the aqueous fluid is released from a hydrated organic or inorganic solid compound within the tool when the compound is exposed to the well bore environment.

41. The method of claim 40 wherein the well bore environment comprises a well bore temperature of at least about 200 degrees Fahrenheit.

42. The method of claim 39 wherein the tool or the component thereof is exposed to the aqueous fluid before the tool is installed in the well bore.

43. The method of claim 39 wherein the tool or the component thereof is exposed to the aqueous while the tool is installed within the well bore.

44. The method of claim 37 wherein the tool or the component thereof decomposes via hydrolysis.

45. The method of claim 37 wherein the decomposition comprises loss of structural integrity of the tool or the component thereof.

46. The method of claim 37 wherein the decomposition comprises loss of functional integrity of the tool or the component thereof.

47. The method of claim 37 wherein the tool or the component thereof decomposes within about a predetermined amount of time.

48. The method of claim 37 wherein the chemical solution comprises: a caustic fluid, an acidic fluid, an enzymatic fluid, an oxidizer fluid, a metal salt catalyst solution or a combination thereof.

49. The method of claim 37 wherein the chemical solution is applied to the tool or the component thereof before the downhole operation.

50. The method of claim 37 wherein the chemical solution is applied to the tool or the component thereof during the downhole operation.

51. The method of claim 37 wherein the chemical solution is applied to the tool or the component thereof after the downhole operation.

52. The method of claim 37 wherein the chemical solution is applied to the tool or the component thereof via a timer-controlled operation.

53. The method of claim 37 wherein the chemical solution is applied to the tool or the component thereof via a mechanical operation.

54. The method of claim 37 wherein the chemical solution is applied to the tool or the component thereof via a hydraulic operation.

55. The method of claim 37 wherein the chemical solution is applied to the tool or the component thereof via an electrical operation.

56. The method of claim 37 wherein the chemical solution is applied to the tool or the component thereof using a communication means.

57. The method of claim 37 wherein the chemical solution is applied to the tool or the component thereof by dispensing the chemical solution into the well bore.

58. The method of claim 57 wherein the dispensing step comprises injecting the chemical solution into the well bore.

59. The method of claim 57 wherein the dispensing step comprises: lowering a frangible object containing the chemical solution into the well bore; and breaking the frangible object.

60. The method of claim 57 wherein the dispensing step comprises: lowering a conduit into the well bore; and flowing the chemical solution through the conduit onto the tool.

61. The method of claim 37 wherein the dart contains the chemical solution.

62. The method of claim 37 wherein the tool or the component thereof contains the chemical solution.

63. The method of claim 37 wherein the moving step comprises pumping a fluid into the well bore behind the dart.

64. The method of claim 37 wherein the moving step comprises allowing the dart to free fall by gravity.

65. The method of claim 37 wherein the biodegradable material comprises a degradable polymer comprising one or more compounds selected from the group consisting of polysaccharides, chitin, chitosans, proteins, aliphatic polyesters, poly(lactides), poly(glycolides), poly(ϵ-caprolactones), poly(hydroxybutyrates), poly(anhydrides), aliphatic polycarbonates, poly(orthoesters), poly(amino acids), poly (ethylene oxides), polyphosphazenes, polyphenyllactide), and poly(lactic acid).

66. The method of claim 37 wherein the degradable polymer comprising one or more compounds selected from the group consisting of polysaccharides, chitin, chitosans, poly(ethylene oxides), poly(phenyllactide), and polyphosphazenes.

67. A system for applying a chemical solution to a disposable downhole tool or the component thereof that desirably decomposes when exposed to a well bore environment comprising an enclosure for containing the chemical solution; wherein the chemical solution catalyzes decomposition of the tool or the component thereof; wherein the tool comprises a frac plug, a bridge plug, or a packer fabricated from a biodegradable material and wherein the biodegradable material comprises a degradable polymer, and wherein the enclosure is broken to release the chemical solution, wherein the enclosure is lowered to the tool on a slick line.

68. The system of claim 67 wherein the enclosure is disposed on the tool.

69. The system of claim 67 further comprising an activation mechanism for releasing the chemical solution from the enclosure.

70. The system of claim 69 wherein the activation mechanism is a frangible enclosure body.

71. The system of claim 69 wherein the activation mechanism is timer-controlled.

72. The system of claim 69 wherein the activation mechanism is mechanically operated.

73. The system of claim 69 wherein the activation mechanism is hydraulically operated.

74. The system of claim 69 wherein the activation mechanism is electrically operated.

75. The system of claim 69 wherein the activation mechanism is operated by a communication means.

76. The system of claim 67 wherein the enclosure is dropped into the well bore to engage the tool.

77. The system of claim 67 further comprising a conduit extending into the well bore to apply the chemical solution onto the tool or the component thereof.

78. The system of claim 67 wherein the chemical solution comprises: a caustic fluid, an acidic fluid, an enzymatic fluid, an oxidizer fluid, a metal salt catalyst solution or a combination thereof.

79. The system of claim 67 wherein the disposable downhole tool or the component thereof comprises a degradable polymer comprising one or more compounds selected from the group consisting of polysaccharides, chitin, chitosans, proteins, aliphatic polyesters, poly(lactides), poly(glycolides), poly(ϵ-caprolactones), poly(hydroxybutyrates), poly(anhydrides), aliphatic polycarbonates, poly(orthoesters), poly(amino acids), poly(ethylene oxides), polyphosphazenes, poly(phenyllactide), and poly(lactic acid).

80. The system of claim 67 wherein the degradable polymer comprising one or more compounds selected from the group consisting of polysaccharides, chitin, chitosans, poly(ethylene oxides), poly(phenyllactide), and polyphosphazenes.

81. A method of applying a chemical solution to a disposable downhole tool or the component thereof that desirably degrades when exposed to a well bore environment, comprising: lowering an enclosure comprising the chemical solution into the well bore, wherein the enclosure is separate from the disposable downhole tool or the component thereof; and releasing the chemical solution, wherein the chemical solution catalyzes decomposition of the tool or the component thereof, and wherein the disposable downhole tool or the component thereof comprises a degradable polymer comprising one or more compounds selected from the group consisting of polysaccharides, chitin, chitosans, poly(ethylene oxides), poly(phenyllactide), and polyphosphazenes.

82. The method of claim 81 further comprising releasing the chemical solution from storage integral to the tool.

83. The method of claim 81 further comprising releasing the chemical solution from storage external to the tool.

84. The method of claim 81 further comprising dispensing the chemical solution into the well bore.

85. The method of claim 81 wherein the degradation comprises loss of structural integrity of the tool or the component thereof.

86. The method of claim 81 wherein the degradation comprises loss of functional integrity of the tool or the component thereof.

87. The method of claim 81 wherein the tool or the component thereof degrades within about a predetermined amount of time.

88. The method of claim 81 wherein the releasing step comprises a timer-controlled operation, a mechanical operation, a hydraulic operation, an electrical operation, an operation using a communication means, or a combination thereof.

89. The method of claim 81 wherein the releasing step comprises breaking a container that stores the chemical solution.

90. The method of claim 81 wherein the tool comprises a frac plug, a bridge plug, or a packer.

91. The method of claim 81 wherein the disposable downhole tool or the component thereof comprises a degradable polymer comprising one or more compounds selected from the group consisting of polysaccharides, chitin, chitosans, proteins, aliphatic polyesters, poly(lactides), poly(glycolides), poly(ϵ-caprolactones), poly(hydroxybutyrates), poly(anhydrides), aliphatic polycarbonates, poly(orthoesters), poly(amino acids), poly(ethylene oxides), polyphosphazenes, poly(phenyllactide), and poly(lactic acid).

92. The method of claim 81 wherein the enclosure is lowered into the wellbore on a slick line.

* * * * *